US012024917B2

(12) United States Patent
McCugh

(10) Patent No.: US 12,024,917 B2
(45) Date of Patent: Jul. 2, 2024

(54) FENCE OR RAIL CONSTRUCTION

(71) Applicant: Darrin McCugh, Kingsport, TN (US)

(72) Inventor: Darrin McCugh, Kingsport, TN (US)

( * ) Notice: Subject to any disclaimer, the term of this patent is extended or adjusted under 35 U.S.C. 154(b) by 175 days.

(21) Appl. No.: 17/462,498

(22) Filed: Aug. 31, 2021

(65) Prior Publication Data

US 2022/0064983 A1 Mar. 3, 2022

Related U.S. Application Data

(60) Provisional application No. 63/072,574, filed on Aug. 31, 2020.

(51) Int. Cl.
*E04H 17/14* (2006.01)

(52) U.S. Cl.
CPC ..... *E04H 17/1439* (2013.01)

(58) Field of Classification Search
None
See application file for complete search history.

(56) References Cited

U.S. PATENT DOCUMENTS 6,755,394 B2 * 6/2004 Forbis ..... E04H 17/1417 256/65.01
7,896,398 B2 * 3/2011 Suda ..... B25G 3/10 482/35
8,833,737 B2 * 9/2014 Langenwalter ..... E04H 17/1426 256/67
2003/0007830 A1 * 1/2003 Bang ..... B25G 3/18 403/327
2003/0201432 A1 * 10/2003 Norman ..... E04F 11/1817 256/65.08
2005/0067609 A1 * 3/2005 Walmsley ..... E04H 17/1439 256/65.01
2006/0002759 A1 * 1/2006 Blackman ..... F16B 7/18 403/109.3
2010/0044662 A1 * 2/2010 Walmsley ..... E04H 17/1447 29/428
2011/0001105 A1 * 1/2011 Lo ..... E04H 17/1447 256/65.08

* cited by examiner

*Primary Examiner* — Daniel J Wiley
(74) *Attorney, Agent, or Firm* — Leason Ellis LLP

(57) ABSTRACT

A method for constructing a picket fence section includes the steps of: inserting a plurality of spring clips into a hollow interior of each of a plurality of hollow pickets. Each spring clip has a first leg and an opposing second leg that includes a locking protrusion that extends outwardly from the second leg. Each spring clip is disposed within the hollow interior of one hollow picket such that locking protrusion extends through one corresponding first hole formed in the one hollow picket. The plurality of pickets are coupled to a plurality of rails with each rail including a longitudinal locking channel and each picket being coupled to the plurality of rails by inserting the locking protrusions into the longitudinal locking channels of the corresponding rails, thereby coupling the hollow pickets to the corresponding rails.

17 Claims, 4 Drawing Sheets

FENCE OR RAIL CONSTRUCTION

CROSS REFERENCE TO RELATED APPLICATION

The present application claims priority to and the benefit of U.S. patent application Ser. No. 63/072,574, filed Aug. 31, 2020, which is hereby incorporated by reference in its entirety.

TECHNICAL FIELD

The present disclosure is directed to fences and fence material, as well as rails, and more particularly, is directed to picket fence or rail materials that are designed to be easily assembled and also accommodates racking of the fence or rail along sloped surfaces.

BACKGROUND

As is well known, a fence is a barrier, railing, or other upright structure, typically of wood or metal, enclosing an area of ground to mark a boundary, control access, or prevent escape. There are different types of fences, including chain-link fences and picket fences to name a few. Picket fences are a type of fence often used decoratively for domestic boundaries, distinguished by their evenly spaced vertical boards, the pickets, attached to horizontal rails.

SUMMARY

A picket fence section includes a plurality of hollow pickets. Each hollow picket has a first wall and an opposing second wall and a plurality of first holes formed through the second wall of the picket and spaced apart from one another. The picket fence section also includes a plurality of rails with each rail including a longitudinal locking channel. A plurality of coupling elements are received within a hollow interior of the plurality of hollow pickets for coupling the plurality of pickets to the plurality of rails to form the picket fence section. Each coupling element comprises a spring clip having a first leg and an opposing second leg that includes a locking protrusion that extends outwardly from the second leg. Each spring clip is disposed within the hollow interior of one hollow picket such that the first leg is disposed against the first wall and the locking protrusion extends through one corresponding first hole formed in the one hollow picket into the longitudinal locking channel of one corresponding rail, thereby coupling the one hollow picket to the one corresponding rail.

The snap engagement between the locking protrusion and the longitudinal locking channel provides a quick, easy mechanism for attaching the pickets to the rails of the fence section. This arrangement also allows for raking of the fence section along a sloped surface.

A method for constructing a picket fence section comprising the steps of:

inserting a plurality of spring clips into a hollow interior of each of a plurality of hollow pickets, each hollow picket having a first wall and an opposing second wall and a plurality of first holes formed through the second wall of the picket and spaced apart from one another, each spring clip having a first leg and an opposing second leg that includes a locking protrusion that extends outwardly from the second leg, wherein each spring clip is disposed within the hollow interior of one hollow picket such that the first leg is disposed against the first wall and the locking protrusion extends through one corresponding first hole formed in the one hollow picket; and coupling the plurality of pickets to a plurality of rails, each rail including a longitudinal locking channel and each picket being coupled to the plurality of rails by inserting the locking protrusions into the longitudinal locking channels of the corresponding rails, thereby coupling the hollow pickets to the corresponding rails.

BRIEF DESCRIPTION OF THE DRAWING FIGURES

DETAILED DESCRIPTION OF CERTAIN EMBODIMENTS

FIGS. 1-4B illustrate a fence section 100 in accordance with one embodiment of the present invention. The illustrated fence section 100 is of a picket fence type and therefore, includes a plurality of pickets 110 and a plurality of rails 200 to which the pickets 110 are coupled. The pickets 110 are intended to be oriented vertically and parallel to one another, while the plurality of rails 200 are most often oriented horizontally. In the event that at least a section of the fence is installed on a slope, the rails 200 may be oriented in a non-horizontal manner.

Figure 1:
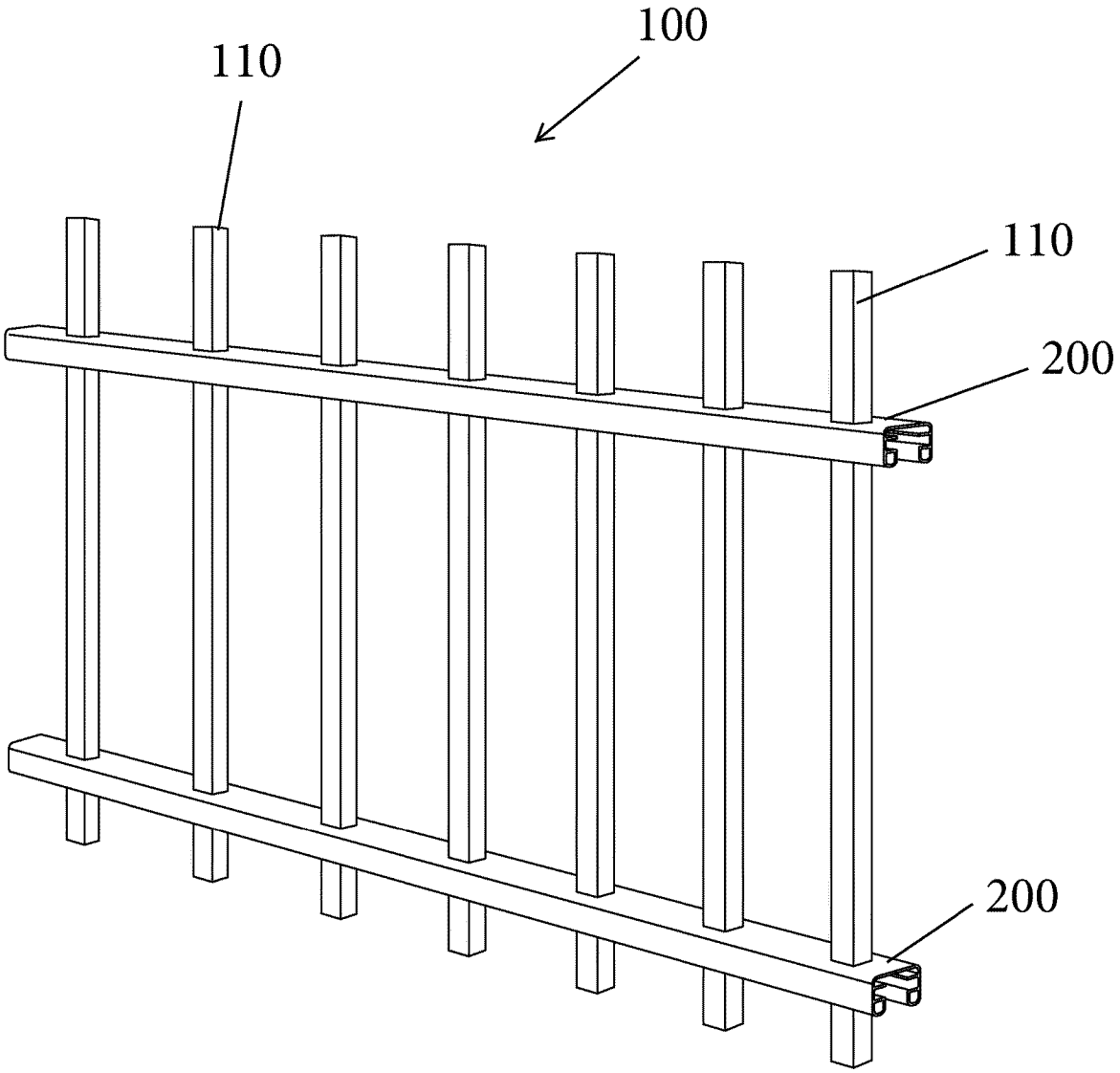
FIG. 1 is front perspective view of a picket fence section in accordance with one embodiment.
Figure 2:
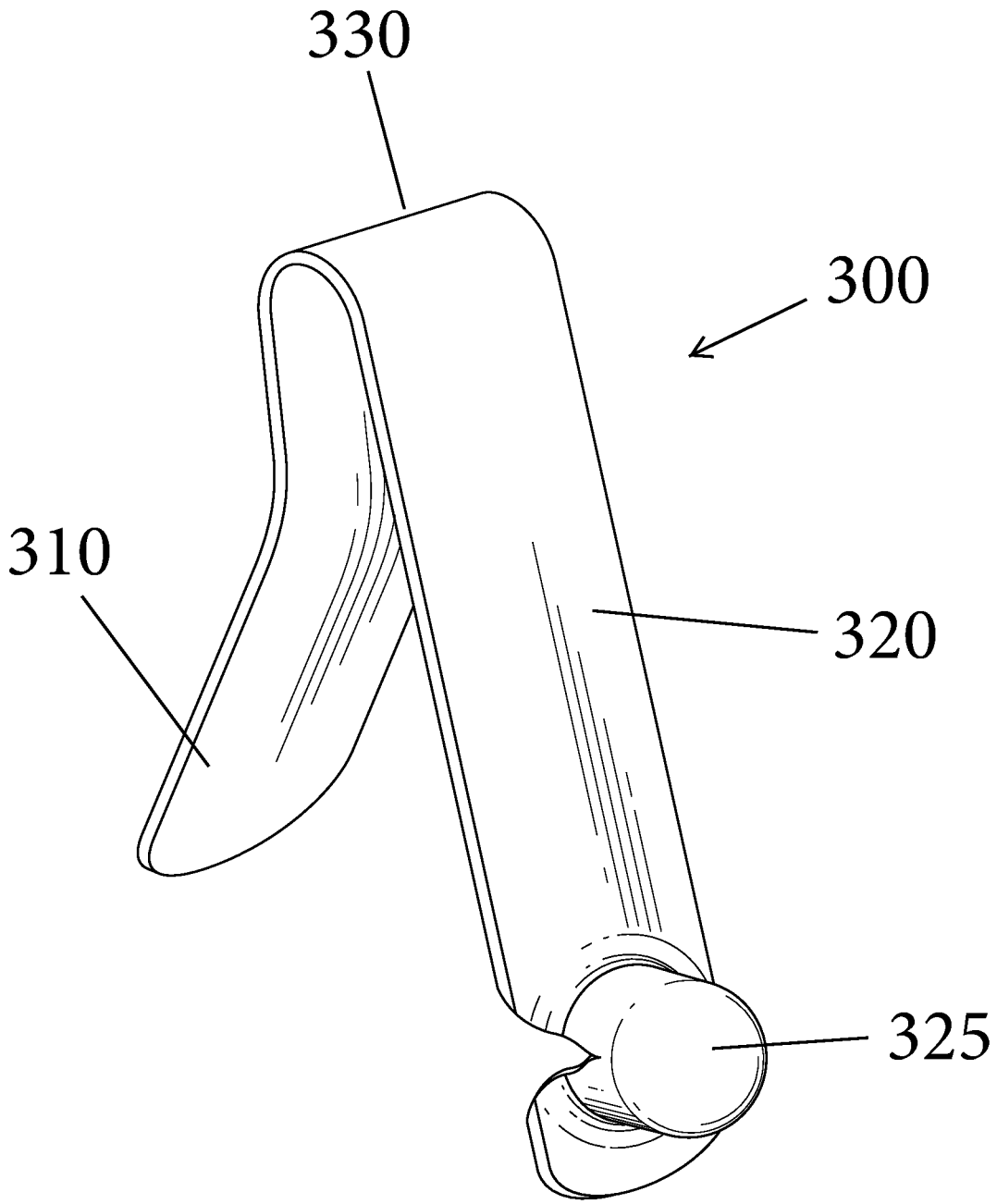
FIG. 2 is a perspective view of a coupling member (spring clip) used to attach each picket to a corresponding rail.

In FIG. 1, there are two rails 200; however, there can be more than two rails 200, such as three or mail rails 200 that are part of the fence section 100.

Picket 110

The plurality of pickets 110 can come in any number of different sizes and shapes and be formed from different materials. In the illustrated embodiment, each picket 110 is a tubular structure with a hollow center. The picket 110 can be formed of metal or rigid plastic or other material. In the figures, each picket 110 has a square cross-sectional shape and is defined by a first wall 112 and an opposing second wall 114.

Along the second wall 114, there are strategically placed holes 120 that are formed through the second wall 114. The holes 120 are thus spaced from one another and are formed at locations along the height of the picket 110. As described below, the shape and size of the holes 120 are selected in view of the coupling element 300 that is used to couple each picket 110 to the plurality of rails 200.

Rail 200

Each rail 200 is an elongated structure as shown in FIGS. 1 and 3-4B. The rail 200 has a top wall 202 and a first leg 210 and an opposing second leg 220 that is spaced across from the first leg 210 with a first space 219 being defined therebetween. The first and second legs 210, 220 extend downwardly from the top wall 202. The first leg 210 has a first tubular portion 215 and similarly, the second leg 220 has a second tubular portion 225. The first tubular portion 215 and the second tubular portion 225 run parallel to one another with the first space 219 being located between the first tubular portion 215 and the second tubular portion 225.

The first tubular portion 215 has a curved bottom edge 211 and the second tubular portion 225 similarly has a curved bottom edge 221. The first tubular portion 215 has a top edge 213 and the second tubular portion 225 has a top edge 223. The top edge 213 can be a flat (planar) wall and the top edge 223 can be a flat (planar) wall.

The rail 200 also has an intermediate cross wall 230 defines an upper compartment 240 (a second space) that is formed between the intermediate cross wall 230 and the top wall 202. The intermediate cross wall 230 extends between the first leg 210 and the second leg 220. The intermediate cross wall 230 and the top wall 202 are oriented parallel to one another.

Between the top edge 213 and the intermediate cross wall 230 there is a first longitudinal channel 250 and between the top edge 223 and the intermediate cross wall 230 there is a second longitudinal channel 260.

The width of the illustrated rail 200 can be greater than a height thereof.

The plurality of rails 200 can be slightly different in certain embodiments in that the plurality of rails 200 can include a first set of rails 200 that have a picket opening 270 formed therethrough that allowed the picket 110 to pass completely through the rail 200, while a second set of rails 200 can be formed so that the picket 110 can only partially pass therethrough. More specifically, in the first set of rails, the picket opening 270 is formed through both the intermediate cross wall 230 and the top wall 202 to allow the picket to pass completely through the rail 200 and allow for adjustment and positioning of the rail 200 along the picket 110 as described herein.

Figure 3:
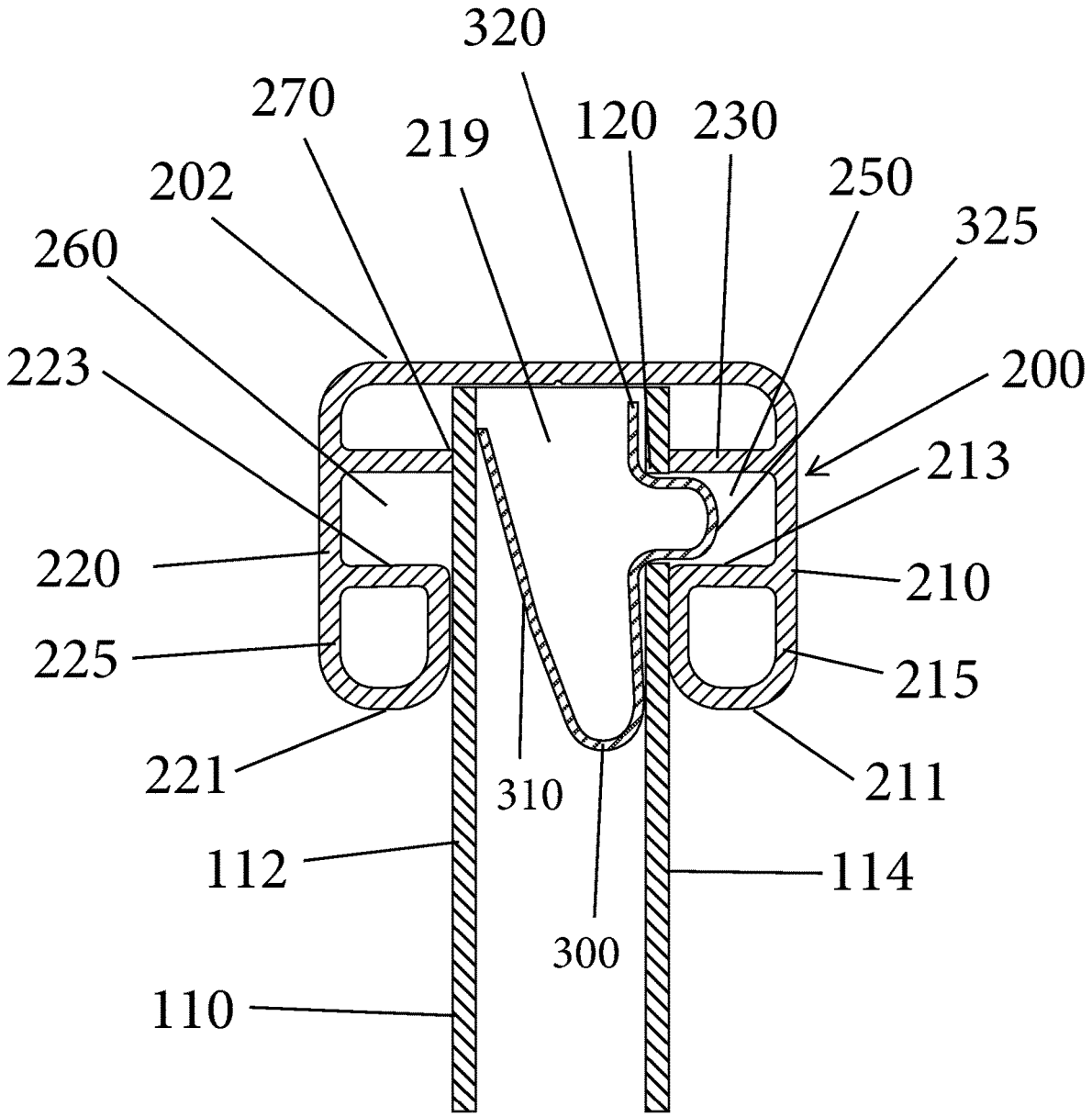
FIG. 3 is a cross-sectional view showing the attachment of the picket to the rail by action of the spring clip.
Figure 4A:
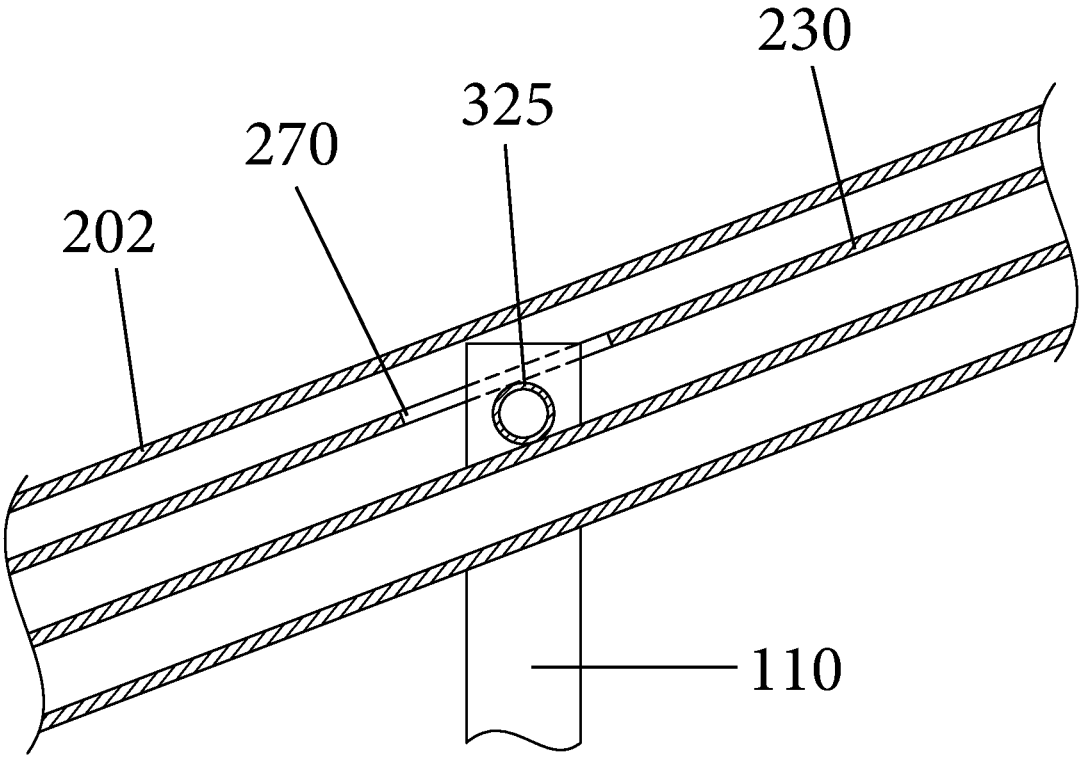
FIG. 4A is a cross-sectional view showing a first racking action of the picket fence section.
Figure 4B:
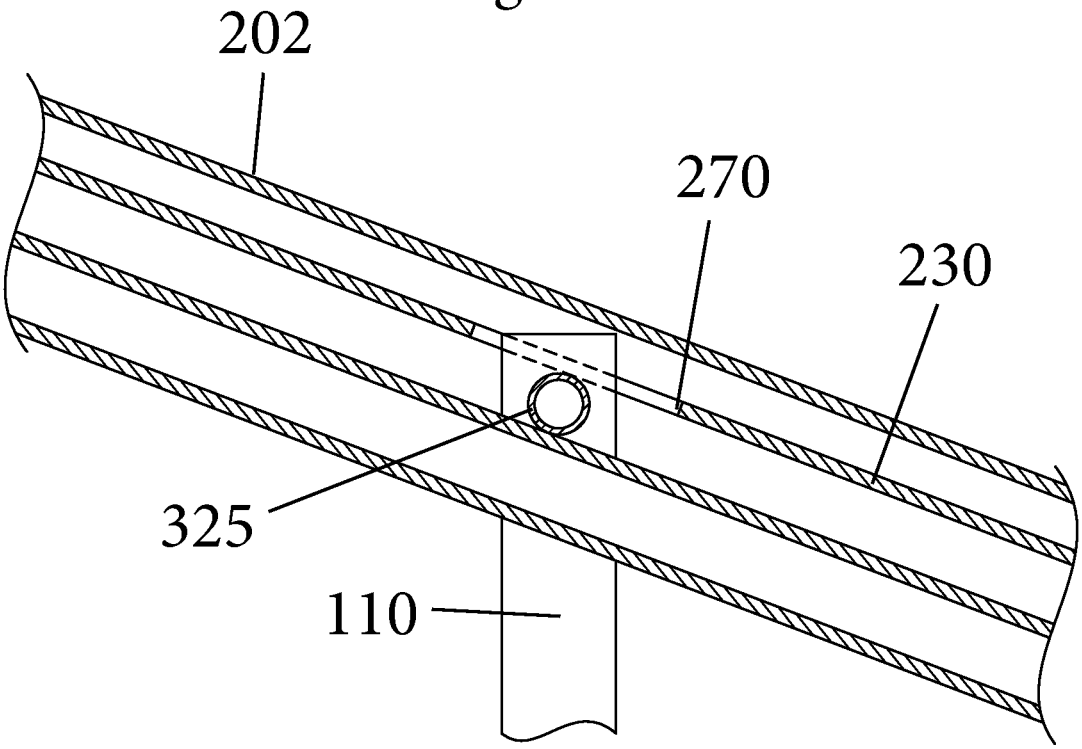
FIG. 4B is a cross-sectional view showing a second racking action of the picket fence section.

It will be appreciated that the shape and size of the picket opening 270 are selected in view of the cross-sectional shape of the picket 110 itself. The complementary shape of the picket opening 270 and the picket 110 prevents excessive lateral movement of the picket 110 within the picket opening 270 but does allow for up and down movement of the picket 110 within the rail 200. As shown in FIGS. 3 and 4A and 4B, the picket opening 270 has a width (W) and a length (L). The width (W) extends in the direction from the first leg 210 to the second leg 220, while the length (L) is the direction along the longitudinal length of the rail 200. As shown in FIG. 3, the cross-sectional shape of the picket opening 270 in the width direction has smaller tolerances in that the picket 110 snugly fits in the picket opening 270 in the width direction (W). However, as shown in FIGS. 4A and 4B, there is more tolerance in the picket opening 270 in the length direction (L). In other words, the picket 110 is not snugly fit in the length direction (L) of the picket opening 270 and there is some play (lateral shifting) allowed (to accommodate a racking action as described below). In FIG. 4A, the fence section 100 is in a first position in which the rails 200 are generally horizontal and parallel to the ground. In this position, the picket 110 can be centrally located within the picket opening 270 with spacing on either side of the picket 110 in the length direction (L). As the fence section 100 is racked (see below), the rails 200 pivot relative to the picket 110 and the relative position of the picket 110 within the picket opening 270 shifts as the rail 200 moves to a non-horizontal position and is no longer parallel to the ground. As the rails moves in this manner, the picket 110 can shift towards one end (edge) of the picket opening 270 as shown in FIG. 4B. By being slightly oversized in the length direction (L), the picket opening 270 accommodates such racking action.

The rail 200 can be formed of any number of suitable materials including but not limited to a metal and a rigid plastic.

Coupling Element 300

As mentioned, each coupling element 300 is designed to facilitate connection between the picket 110 and the rail 200.

As shown in the figures, the coupling element 300 can be in the form of a spring clip or the like that is generally V-shaped. The coupling element 300 has a first leg 310 and an opposing second leg 320 that joins the first leg 310 at a curved portion 330 of the coupling element 300. The V-shape bent nature of the coupling element 300 provides a spring clip (biased structure) due to its structure and the material used to form the coupling element 300. For example, the coupling element 300 is formed of a metal. When the legs 310, 320 are compressed and moved toward one another, the coupling element 300 stores energy.

The first leg 310 can be a smooth, unadorned leg, while the second leg 320 has a locking protrusion 325 that extends outwardly from an outer surface of the second leg 320. The locking protrusion 325 thus extends in a direction away from the first leg 310. The locking protrusion 325 is shaped and sized to engage the rail 200 and more particularly, the locking protrusion 325 is shaped and sized to be received within the first longitudinal channel 250. As described herein, the reception of the locking protrusion 325 into the first longitudinal channel 250 results in attachment of the picket 110 to the rail 200. The first longitudinal channel 250 can be thought of as being a locking (retention) channel.

The locking protrusion 325 is integrally formed with the coupling element 300 and can be formed using conventional techniques, such as a stamping process.

The coupling element 300 is received within the hollow interior of the picket 110 and is positioned such that the first leg 310 of the coupling element 300 is positioned against the first wall 112 and the second leg 320 faces the second wall 114 and the locking protrusion 325 is placed in registration with the hole 120, thereby allowing the locking protrusion 325 to pass through the hole 120 due to the outward biasing force of the coupling element 300. In the illustrated embodiment, the locking protrusion 325 has a generally rounded construction and can be generally cylindrically shaped with a dome-shaped end as shown (however, other shapes are equally possible). The shape and size of the locking protrusion 325 are complementary to the shape and size of the hole 120 to allow the locking protrusion 325 to pass through the hole 120 of the picket 110. The first leg 310 thus seats against the first wall 112, while the second leg 320 seats against the second wall 114.

In other words, when the coupling element 300 is received within the hollow interior of the picket 110, the legs 310, 320 of the coupling element 300 are compressed to allow the coupling element 300 to be received within the hollow interior. In an at rest position, a width of the coupling element 300 is greater than a width of the hollow interior of the picket 110. Thus, when the coupling element 300 is compressed and inserted into the hollow interior of the picket 110, the coupling element 300 stores energy due to compression of the legs 310, 320. The coupling element 300 is positioned within the hollow interior of the picket 110 such that the locking protrusion 325 is placed in registration with the hole 120 resulting in the locking protrusion 325 passing through the hole 120 and being accessible along the exterior of the picket 110.

Accordingly, for each hole 120 formed in the picket 110, there is one coupling element 300. When the fence 100 includes three rails 200, there are three holes 120 formed at specific locations along the height (length) of the picket 110 for receiving three coupling elements 300, with one coupling element 300 being used to couple the picket 110 to one of the corresponding rails 200. When the fence section 100 includes two rails 200, there are two holes 120.

It will be appreciated that each coupling element 300 can be inserted by hand into the hollow interior of the picket 110 or a tool or machine can be used to insert and position the coupling elements 300 within the hollow interior of the picket 110. For example, an applicator in the form of an elongated tool that grasps and can compress the coupling element 300 to allow insertion into the hollow interior and then allow release of the coupling element (spring clip) 300 at the target location where the hole is located. The tool or automated robotic tool can thus have a pair of jaws that grasp and compress and then later release the spring clip.

Method of Construction

The fence 100 can be constructed by completing the following steps. First, the coupling elements 300 are inserted into the hollow interior of the picket 110 and positioned such that the locking protrusions 325 pass through the corresponding holes 120.

The rails 200 are then joined to the picket 110 by inserting the picket 110 through the picket opening 270 formed in the rail 200.

The rails 200 are then mated to the pickets 110 by positioning each rail 200 with respect to one corresponding locking protrusion 325 to cause the locking protrusion 325 to slide into and engage the first longitudinal channel 250. The curved bottom edge 211 of the first tubular portion 215, that is below the first longitudinal channel 250, acts as a cam surface that allows the locking protrusion 325 to slide along the curved bottom edge 211 and into the first longitudinal channel 250. The curved surfaces of the locking protrusion 325 thus interact with the curved bottom edge 211 to facilitate the locking between the picket 110 and the rail 200. One will appreciate that as the fully extended locking protrusion 325 contacts the curved bottom edge 211 and the rail 200 is moved downward over the picket 110, the locking protrusion 325 is effectively pushed back and partially retracts within the hollow interior of the picket 110. In the partially retracted position, the locking protrusion 325 stores energy. The rail 200 is further moved (e.g., lowered) along the picket 110 until the partially retracted locking protrusion 325 is placed in registration with the first longitudinal channel 250 at which time, the stored energy of the coupling element 300 is released and then locking protrusion 325 snaps into place within the first longitudinal channel 250, thereby locking the picket 110 to the rail 200. This process is performed for each rail 200 of the fence 100.

As shown in FIG. 1, in the case of the illustrated three rail fence, the pickets 110 pass completely through bottom and middle rails 200, while the top end of the pickets 110 do not pass completely through the top rail. Instead, the top end of the pickets 110 can terminate within the body of the rail above the first longitudinal channel 250 such as in the upper compartment 240 as shown in FIG. 3. However, it will be understood that in some embodiments, the top ends of the pickets 110 can be located above the top rails 200. When the picket 110 does extend completely through the rail 200, the picket opening 270 extends through the intermediate cross wall 230 and the top wall 202.

The construction of the pickets 110, rails 200 and coupling elements 300 are designed for easy assembly of the fence 100.

Posts

It will be appreciated that the figures illustrate one fence section 100 that is part of a larger overall fence. The fence section 100 is intended to be mounted to support posts or the like (not shown) that are driven into the ground and provide support at the ends of the fence section 100. The fence section 100 can be anchored to the posts using conventional techniques.

Fence Racking (FIGS. 4A and 4B)

As is known, rackable fence panels are modular fence panels purpose-built to make matching a slope much easier. More specifically, a raked fence is made with a strong angle in mind so that the rails are parallel to the ground and the pickets point straight up. With this method, the gap between the pickets and the ground stays the same throughout the entire fence, on both sloped and flat areas.

The present fence 100 is constructed to allow for positioning along a sloped surface due to the manner by which the pickets 110 are attached to the rails 200. In particular, one or more of the anchored pickets 110 (those connected to the rails 200) can be raised and lowered relative to one or more other anchored pickets 110 that are attached to the same rails 200. This ability to freely raise and lower one or more pickets 110 relative to one or more other pickets 110 results in the rails 200 being adjusted and set to an angle. This movement occurs without having the locking protrusions 325 disengage from the locking channel (the first longitudinal channel 250).

During this racking action, the rails 200 pivot about the locking protrusions 325 in response to the degree of slope. The rounded nature of the locking protrusions 325 provide surfaces about which the rails 200 can pivot. Either end of the fence section 100 can be raised or lowered in view of the slope. Much like a see-saw, when a first end of the fence section 100 is raised, the other end of the fence section 100 is lowered as a result of the rounded locking protrusions 325 providing pivots about which the rails 200 move.

FIGS. 4A and 4B show the shifting action of the rails 200 and the movement of the picket 110 within the picket opening 170 in the length direction (L). As the rail 200 is racked (angled), the relative position of the rail 200 relative to the picket 110 changes and shape and size of the picket opening 170 in the length direction (L) allow for such pivoting of the rail 200 relative to the picket 110.

While the section 100 is described as being a fence section, it will be appreciated that the section 100 can be used in other settings and implementations, such as a rail on a staircase or similar structure.

It is to be understood that like numerals in the drawings represent like elements through the several figures, and that not all components and/or steps described and illustrated with reference to the figures are required for all embodiments or arrangements.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising", when used in this specification, specify the presence of stated features, integers, steps, operations, elements, and/or components, but do not precludes the presence or addition of one or more other features, integers, steps, operations, elements, components, and/or groups thereof.

Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

The subject matter described above is provided by way of illustration only and should not be construed as limiting. Various modifications and changes can be made to the subject matter described herein without following the example embodiments and applications illustrated and described, and without departing from the true spirit and scope of the present invention, which is set forth in the following claims.

What is claimed is:

1. A picket fence section comprising:

a plurality of hollow pickets, each hollow picket having:
- a first wall and an opposing second wall, and
- a plurality of first holes formed through the second wall of the picket and spaced apart from one another;
- a plurality of rails, each rail including:
  - a top wall,
  - first and second rail legs extending downwardly from the top wall,
  - a longitudinal locking channel formed on at least one of the first and second rail legs, and
  - a first portion formed below the longitudinal locking channel, the first portion comprising a bottom edge; and
- a plurality of coupling elements that are received within a hollow interior of the plurality of hollow pickets for coupling the plurality of pickets to the plurality of rails to form the picket fence section, each coupling element comprising:
- a spring clip having a first spring clip leg and an opposing second spring clip leg that is joined to the first spring clip leg at a curved end portion and the second spring clip leg includes a locking protrusion that extends outwardly from the second spring clip leg at a location spaced from an end of the second spring clip leg, wherein each spring clip is disposed within the hollow interior of one hollow picket such that an end of the first spring clip leg is disposed against and internal to the first wall and the end of the second spring clip leg is located internal to the second wall and the locking protrusion extends through one corresponding first hole formed in one of the plurality of hollow pickets into the longitudinal locking channel of one corresponding rail, wherein, when one of the plurality of rails is lowered into the hollow picket, the bottom edge of the first portion acts as a cam surface to deflect the locking protrusion inwardly until the locking protrusion engages with the longitudinal locking channel, thereby coupling the one hollow picket to the one corresponding rail.

2. The picket fence section of claim 1, wherein the hollow picket has a square cross-section.

3. The picket fence section of claim 1, wherein the first hole has a circular shape and the locking protrusion comprises a rounded structure that projects outwardly from an outer face of the second spring clip leg and is sized to pass through the first hole.

4. The picket fence section of claim 1, wherein an outer surface of the locking protrusion comprises a curved surface.

5. The picket fence section of claim 4, wherein the locking protrusion comprises a rounded bump.

6. The picket fence section of claim 1, wherein the first portion comprises a first tubular portion at a bottom end of the first rail leg and the second rail leg having a second tubular portion at the bottom end of the second rail leg with an open space between the first tubular portion and the second tubular portion.

7. The picket fence section of claim 6, wherein the bottom edge of the first rail leg comprises a first curved bottom edge and the second tubular portion includes a second curved bottom edge.

8. The picket fence section of claim 6, wherein the longitudinal locking channel is formed between the first tubular portion and an intermediate wall that extends between the first rail leg and the second rail leg.

9. The picket fence section of claim 8, wherein the longitudinal locking channel is defined between the intermediate wall, which is planar in nature, and a top planar edge of the first tubular portion.

10. The picket fence section of claim 6, wherein one picket is received within the open space between the first tubular portion and the second tubular portion.

11. The picket fence section of claim 1, wherein at least some of plurality of rails have through holes formed therethrough to all for complete passage of corresponding pickets through the rails.

12. The picket fence section of claim 1, wherein the spring clip is V-shaped and the first spring clip leg is joined to the second spring clip leg by a curved portion.

13. The picket fence section of claim 12, wherein the spring clip is formed of a metal.

14. The picket fence section of claim 1, wherein in an at rest position, the first spring clip leg is spaced a first distance from the second spring clip leg, and wherein a second distance between the first wall and the second wall of the picket is less than the first distance.

15. The picket fence section of claim 1, wherein a height of the locking protrusion is such that the locking protrusion extends through the first hole formed in the one hollow picket and at least 50% of the height of the locking protrusion is contained within the longitudinal locking channel of the one corresponding rail.

16. A method for constructing a picket fence section according to claim 1, the method comprising the steps of:
- inserting the plurality of spring clips into a hollow interior of each of the plurality of hollow pickets; and
- coupling the plurality of pickets to the plurality of rails by inserting the locking protrusions into the longitudinal locking channels of the corresponding rails, thereby coupling the hollow pickets to the corresponding rails.

17. A picket fence section comprising:

a plurality of hollow pickets, each hollow picket having:
- a first wall and an opposing second wall, and
- a plurality of first holes formed through the second wall of the picket and spaced apart from one another, wherein the first wall is free of the first holes in that the first wall is solid at locations directly opposite locations of the first holes formed in the second wall;
- a plurality of rails, each rail including:
  - a top wall,
  - first and second rail legs extending downwardly from the top wall,
  - a longitudinal locking channel formed on at least one of the first and second rail legs, and
  - a first portion formed below the longitudinal locking channel, the first portion comprising a bottom edge; and
- a plurality of coupling elements that are received within a hollow interior of the plurality of hollow pickets for coupling the plurality of pickets to the plurality of rails to form the picket fence section, each coupling element comprising:

a spring clip having a first spring clip leg and an opposing second spring clip leg that is joined to the first spring clip leg by a rounded end portion, the second spring clip leg including a locking protrusion that extends outwardly from the second spring clip leg at a location that is spaced from an end of the second spring clip leg, the locking protrusion comprising a rounded bump, wherein each spring clip is disposed within the hollow interior of one hollow picket such that an end of the first spring clip leg is disposed against the first wall at a location above one corresponding first hole and the locking protrusion extends through the one corresponding first hole formed in one of the plurality of hollow pickets into the longitudinal locking channel of one corresponding rail, the second spring clip leg seating against the second wall and rounded end portion being disposed below the one corresponding first hole, wherein, when one of the plurality of rails is lowered into the hollow picket, the bottom edge of the first portion acts as a cam surface to deflect the locking protrusion inwardly until the locking protrusion engages with the longitudinal locking channel, thereby coupling the one hollow picket to the one corresponding rail.

* * * * *